US010828640B2

(12) United States Patent
Li et al.

(10) Patent No.: US 10,828,640 B2
(45) Date of Patent: Nov. 10, 2020

(54) MICROFLUIDIC STRUCTURES

(71) Applicant: SPHERE FLUIDICS LIMITED, Babraham (GB)

(72) Inventors: Xin Li, Babraham (GB); Xin Liu, Babraham (GB); Alexandra Clay, Babraham (GB)

(73) Assignee: SPHERE FLUIDICS LIMITED (GB)

( * ) Notice: Subject to any disclaimer, the term of this patent is extended or adjusted under 35 U.S.C. 154(b) by 336 days.

(21) Appl. No.: 15/754,754

(22) PCT Filed: Sep. 6, 2016

(86) PCT No.: PCT/GB2016/052737
§ 371 (c)(1),
(2) Date: Feb. 23, 2018

(87) PCT Pub. No.: WO2017/046565
PCT Pub. Date: Mar. 23, 2017

(65) Prior Publication Data

US 2018/0250677 A1 Sep. 6, 2018

(30) Foreign Application Priority Data

Sep. 16, 2015 (GB) ..... 1516447.8

(51) Int. Cl.
*B01L 3/00* (2006.01)
*B01L 3/02* (2006.01)

(52) U.S. Cl.
CPC ..... *B01L 3/502776* (2013.01); *B01L 3/0241* (2013.01); *B01L 3/502715* (2013.01);
(Continued)

(58) Field of Classification Search
CPC ..... B01L 3/502776; B01L 3/502715; B01L 3/0241; B01L 3/502784; B01L 2300/0816;
(Continued)

(56) References Cited

U.S. PATENT DOCUMENTS 9,278,350 B1 * 3/2016 Hegab ..... B01F 5/0471
10,247,655 B2 * 4/2019 Smith ..... G01N 15/1434
(Continued)

FOREIGN PATENT DOCUMENTS

EP 2805769 A1 11/2014

OTHER PUBLICATIONS

Lagus, et al; High throughout single-cell and multiple-call micro-encapsulation: Journal of Visualized Experiments, 2012, Issue 64, e4096; 7 Pages.
(Continued)

*Primary Examiner* — Lore R Jarrett
(74) *Attorney, Agent, or Firm* — Renner Kenner Greive Bobak Taylor & Weber

(57) ABSTRACT

A microfluidic structure for spacing out and aligning entities in an aqueous suspension is provided. The structure comprises: a channel for guiding entities in an aqueous suspension; a first comb of first inlets arranged on a first side of the channel for introducing a spacing medium into the channel; and a second comb of second inlets arranged on a second side of the channel for introducing the spacing medium into the channel; wherein the first side is opposite the second side, and wherein one of the first inlets has a corresponding, respective one of the second inlets at a substantially similar longitudinal position along the channel.

8 Claims, 3 Drawing Sheets

(52) U.S. Cl.
CPC . *B01L 3/502784* (2013.01); *B01L 2200/0647* (2013.01); *B01L 2200/0673* (2013.01); *B01L 2300/0816* (2013.01); *B01L 2300/0867* (2013.01); *B01L 2300/161* (2013.01); *B01L 2400/0463* (2013.01); *B01L 2400/0487* (2013.01)

(58) Field of Classification Search
CPC ..... B01L 2200/0673; B01L 2400/0487; B01L 2300/161; B01L 2400/0463; B01L 2200/0647; B01L 2300/0867; B01L 3/0268; B01L 2200/0652; B01L 2400/0415; B01L 2400/043; G01N 27/44791; G01N 15/1484; G01N 2015/149
See application file for complete search history.

(56) References Cited

U.S. PATENT DOCUMENTS

| | | | | |
|---|---|---|---|---|
| 10,545,083 | B2 * | 1/2020 | Smith | G01N 15/1031 |
| 2004/0043506 | A1 | 3/2004 | Haussecker et al. | |
| 2005/0032240 | A1 | 2/2005 | Lee et al. | |
| 2006/0051329 | A1 * | 3/2006 | Lee | B01F 5/0646 424/93.7 |
| 2008/0003142 | A1 | 1/2008 | Link et al. | |
| 2009/0273105 | A1 | 11/2009 | Mcquade et al. | |
| 2010/0021984 | A1 | 1/2010 | Edd et al. | |
| 2010/0285975 | A1 | 11/2010 | Mathies et al. | |
| 2010/0330693 | A1 | 12/2010 | Chapin et al. | |
| 2011/0223314 | A1 * | 9/2011 | Zhang | B01J 13/14 427/2.1 |
| 2012/0021984 | A1 | 1/2012 | Moyle | |
| 2012/0091004 | A1 * | 4/2012 | Abell | B01J 19/0093 204/556 |
| 2012/0108721 | A1 | 5/2012 | Mazutis | |
| 2013/0236901 | A1 | 9/2013 | Potier et al. | |

OTHER PUBLICATIONS

Wu, et al.; "Encapsulation of single cells on a microfluidic device integrating droplet generation with fluorescence-activated droplet sorting" Biomedical Microdevices, 2013; vol. 15, Issue 3, pp. 553-560.

Kemna EW, et al; "High-yield cell ordering and deterministic cell-in-droplet encapsulation using Dead flow in a curved microchannel"; Lap Chip, 2012, vol. 12, Issue 16, pp. 2281-2887.

Ramiji R., et al.; "Single cell kinase signaling assay using pinched flow coupled droplet microfluidics"; Biomicrofluidics, 2014, vol. 19, Issue 3; 034104.

Jon F. Edd, et al; "Controlled encapsulation of single-cells into monodisperse picolitre drops"; Lab Chip; 2008, Issue 8, pp. 1262-1264.

D. Jin, et al.; "A microfluidic device enabling high-efficiency single cell trapping" Biomicrofluidics, 2015; vol. 9, Issue 1, 014101.

Adam R. Abate, et al.; Beating Poisson encapsulation statistics using close-packed ordering; Lab Chip, 2009, Issue 9, pp. 2628-2631.

Koster S. et al.; "Drop-based mlcrofluidic devices for encapsulation of single cells" Lap Chip, 2008, Issue 8, pp. 1110-1115.

T.M. Tran, et al.; From tubes to drops: Droplet-based microfluidics for ultrahigh-throughout biology; journal of Physics D; Applied Physics, 2013, vol. 46, No. 11; 114004.

Ramesh Ramhi; et al.; Single Cell Encapsulation Using Punched Flow Droplet Microfluidics; http://isgcc.ieee.org/files/2013/12/Isgcc2013 submission 3.pdf (2013).

Chabert, et al; "Microfluidic high-throughput encapsulation and hydrodynamic self-sorting of single cells"; PNAS, Mar. 4, 2008; vol. 5, No. 9, 3191-3196; http://www.pnas.org/content/105/9/3191.full.pdf.

Clausell-Tormos, et al.; Droplet-based microfluidic platforms for the encapsulation and screening of mannalian cells and multicellular organisms; Chemistry & Biology; vol. 15, Issue 8, p. 427-437, May 2008.

* cited by examiner

MICROFLUIDIC STRUCTURES

FIELD OF THE INVENTION

This invention generally relates to microfluidic structures and methods for spacing out and aligning entities, for examples cells, in a suspension.

BACKGROUND TO THE INVENTION

Microfluidic picodroplet technology is an ultra-high throughput analysis approach of up to 1,000 Hz which is especially useful for analysing and profiling large cell libraries containing, for example, from 10,000 to 1,000,000,000 cells at a single cell level. The first and basic step of this technology in single cell analysis applications is to encapsulate cells into picodroplets in a one-picodroplet-one-cell (OPOC) manner, i.e. in which one picodroplet contains only a single cell or other (biological) entity.

However, even for an ideal cell or particle suspension (i.e. cells or particles are evenly suspended in the medium and do not sediment over the period of encapsulation), the number of cells encapsulated in a single picodroplet follows a Poisson distribution.

The current microfluidic design for encapsulating cells into picodroplets comprises a cross junction nozzle with a narrowed aqueous fluid inlet channel to align cells or particles within the microfluidics before being encapsulated into picodroplets. Such narrowed microfluidic channels of, for example 40 um or less in width and height, have a dimension similar to the size of cells or particles, which may cause blockage at the nozzle when aggregated species are present. Furthermore, fluid flow at a small dimension cross junction nozzle generates a high shear force which could cause deformation of cells, for example an elongated deformation along the fluidic flow. This deformation may trigger a cell destruction process which may be irreversible. Prior art can be found in, for example US 2010/021984 A1; US 2011/0223314 A1; US 2008/0003142 A1; US 2012/0108721 A1; US 2010/0285975 A1; US 2013/0236901 A1; EP 2 805 769 A1; US 2006/0051329 A1; US 2009/0273105 A1; US 2005/0032240 A1; "High throughput single-cell and multiple-cell micro-encapsulation", Lagus T P and Edd J F, Journal of Visualized Experiments, 2012, Issue 64, e4096; "Encapsulation of single cells on a microfluidic device integrating droplet generation with fluorescence-activated droplet sorting", Wu L et al., Biomedical Microdevices, 2013, Volume 15, Issue 3, pp. 553-60; "High-yield cell ordering and deterministic cell-in-droplet encapsulation using Dean flow in a curved microchannel", Kemna E W et al., Lab Chip, 2012, Volume 12, Issue 16, pp. 2881-2887; "Single cell kinase signaling assay using pinched flow coupled droplet microfluidics", Ramji R et al., Biomicrofluidics, 2014, Volume 19, Issue 3, 034104; "Controlled encapsulation of single-cells into monodisperse picolitre drops", Jon F. Edd et al., Lab Chip, 2008, Issue 8, pp. 1262-1264; "A microfluidic device enabling high-efficiency single cell trapping"; D. Jin et al., Biomicrofluidics, 2015, Volume 9, Issue 1, 014101; "Beating Poisson encapsulation statistics using close-packed ordering", Adam R. Abate et al., Lab Chip, 2009, Issue 9, pp. 2628-2631; "Drop-based microfluidic devices for encapsulation of single cells", Köster S et al., Lab Chip, 2008, Issue 8, pp. 1110-1115; "From tubes to drops: droplet-based microfluidics for ultra-high-throughput biology", T M Tran et al., Journal of Physics D: Applied Physics, 2013, Volume 46, Number 11, 114004; "Single Cell Encapsulation Using Pinched Flow Droplet Microfluidics", Ramesh Ramji et al., http://isgcc-cieee.org/files/2013/12/Isgcc2013_submission_3.pdf; "Microfluidic high-throughput encapsulation and hydrodynamic self-sorting of single cells", PNAS, Mar. 4, 2008, Volume 5, Number 9, 3191-3196, http://www.pnas.org/content/105/9/3191.full.pdf; "Droplet-Based Microfluidic Platforms for the Encapsulation and Screening of Mammalian Cells and Multicellular Organisms", Jenifer Clausell-Tormos et al., Chemistry & Biology, Volume 15, Issue 8, p. 875.

There is therefore a need for further improvements of microfluidic devices and structures.

SUMMARY OF THE INVENTION

According to a first aspect of the invention, there is therefore provided a microfluidic structure for spacing out and aligning entities in an aqueous suspension, the structure comprising: a channel for guiding entities in an aqueous suspension; a first comb of first inlets arranged on a first side of said channel for introducing a spacing medium into said channel; and a second comb of second inlets arranged on a second side of said channel for introducing said spacing medium into said channel; wherein said first side is opposite said second side, and wherein a said first inlet has a corresponding, respective one of said second inlets at a substantially similar longitudinal position along said channel.

The inventors have realised that the above-described microfluidic structure allows improving upon Poisson distribution while generating a local region adjacent the inlets of homogeneous pressure environment. This ensures that stress applied to the entities, which may be fragile cells or other picodroplet-based entities, is minimised while the entities are guided through the (main) channel.

The first and second combs of inlets allow for spreading one (relatively larger) flow stream into multiple (relatively smaller), and in some embodiments, equal flow streams. As will be further described below, advantageously, a homogeneous hydrodynamic pressure within the inlet region may grant the formation of laminar flow, which may allow for aligning the entities, for example in the middle of the microfluidic channel.

The microfluidic structure further allows for spacing out the entities in the suspension such that the relative number of single entities in a single picodroplet (which may be generated later) compared to the total number of picodroplets to be generated may advantageously be increased. As the entities are spaced out, the probability for obtaining a single entity in a single picodroplet which may be generated from the suspension may be increased since a smaller number of entities per volume may be contained in the suspension which is guided through the (main) channel. The microfluidic structure therefore facilitates single cell encapsulation.

It will be appreciated that the spacing medium introduced into the (main) channel via the first and second inlets may be the same medium as the one forming the suspension in which the entities are contained. However, alternatively, the spacing medium may, in some embodiments, be different to the suspension in which the entities are contained and guided through the (main) channel.

In a preferred embodiment of the microfluidic structure, one or more of the first inlets and corresponding, respective one or more of the second inlets each forms an angle with the channel of less than 90 degrees. This may allow for introducing the spacing medium into the (main) channel generally in the low-direction of the suspension in the channel. The flow of the suspension in the (main) channel may thereby advantageously be less disrupted by the introduction of the spacing medium into the (main) channel.

In a further preferred embodiment of the microfluidic structure, the first inlets are connected to each other via a first comb inlet for the first comb, and wherein the second inlets are connected to each other via a second comb inlet for the second comb. This may advantageously allow for simplifying the introduction of the spacing medium from the first and second inlets into the main channel at the same pressure and/or at the same flow rates from all inlets. The suspension in which the entities are guided through the channel may therefore experience an equal hydrodynamic pressure at the channel region where the first and second inlets lead into the channel. The entities may therefore be subjected to lower stress, which may advantageously increase a survival rate of the entities while they are guided through the microfluidic structure.

In a further preferred embodiment of the microfluidic structure, a part of a said inlet (first and/or second inlet(s)) is coated with a hydrophilic coating. This is particularly useful where the spacing medium is an aqueous spacing medium, such that the coating advantageously reduces difficulties which may arise at the inlets due to wetting. The coating may be, for example polyethylene glycol (PEG) silane.

In a related aspect of the invention, there is provided a method for aligning entities in a suspension in a microfluidic structure, the method comprising: providing a channel on said microfluidic structure for guiding said entities in said suspension; providing a first comb of first inlets arranged on a first side of said channel for introducing a fluid into said channel; providing a second comb of second inlets arranged on a second side of said channel for introducing a said fluid into said channel; wherein said first side is opposite said second side, and wherein a said first inlet has a corresponding, respective one of said second inlets at a substantially similar longitudinal position along said channel; the method further comprising: guiding said suspension comprising said entities through said channel; and introducing said fluid into said channel from one or more of said first inlets at the same time as introducing said fluid into said channel from one or more corresponding, respective said second inlets to align said entities in said suspension in said channel.

As outlined above, the method may therefore allow for spacing out the entities in the suspension and/or aligning the entities in the suspension guided through the channel (for example aligning the entities in the middle of the channel). As outlined above, a higher rate of one-entity-per-one-picodroplet may be obtained when picodroplets are (later) generated from the suspension.

In a preferred embodiment of the method, the fluid is introduced into the channel with a flow rate which is higher than a flow rate of the suspension in the channel to space out the entities in the suspension in the channel. It will be appreciated that by introducing the spacing medium into the channel, the entities are spaced out even if the flow rate of the spacing medium in the first and second inlets is smaller than or equal to the flow rate of the suspension in the (main) channel. This is because the volume of fluid in the channel per area may increase where the spacing medium is introduced into the channel (and in the areas which are downstream from the area(s) at which the first and second inlets are arranged), that is for all flow rates of the spacing medium. However, a larger flow rate of the spacing medium when being introduced into the main channel spaces out the entities in the suspension more significantly. Nonetheless, it will be appreciated that the flow rate of the spacing medium when being introduced in the main channel should not be above a threshold as a too large flow rate may result in, for example, shearing forces and/or hydrodynamic pressure changes in the channel which may disrupt the flow of the suspension carrying the entities, potentially resulting in an undesired deformation of the entities.

In a further preferred embodiment of the method, the fluid is introduced into the channel from a said first inlet with a first flow rate and from a corresponding, respective said second inlet with a second flow rate, wherein the first flow rate and the second flow rate are substantially the same to increase a hydrodynamic pressure homogeneity in the suspension across a width of the channel from the first inlet to the corresponding, respective second inlet. This may allow for reducing any stress which the entities in the suspension may experience while being spaced out and/or aligned in the main channel, as the hydrodynamic pressure gradient across the width of the channel from the first inlet to the corresponding, second inlet may be reduced.

In a further preferred embodiment of the method, the fluid is introduced into the channel generally in a flow direction of the suspension in the channel. As outlined above, this may allow for reducing any potential disruption of the suspension flow in the main channel.

In a related aspect of the invention, there is provided a method for spacing out entities in a suspension, the method comprising: guiding said suspension comprising said entities through a channel of a microfluidic structure; and introducing an aqueous spacing medium into said channel from a first inlet arranged on a first side of said channel and substantially simultaneously introducing said aqueous spacing medium into said channel from a second inlet arranged on a second side of said channel to space out said entities in said suspension in said channel, wherein said first side is opposite said second side, and wherein said first inlet is arranged at a substantially similar longitudinal position along said channel as said second inlet.

In a preferred embodiment of the method, the microfluidic structure comprises a plurality of first inlets and a plurality of second inlets through which the aqueous spacing medium is introduced into the (main) channel.

In a preferred embodiment, the aqueous spacing medium is introduced into the channel with a flow rate which is higher than a flow rate of the suspension in the channel.

In a further preferred embodiment, the flow rates at which the aqueous spacing medium is introduced from the first and second inlets are substantially equal, in order to increase hydrodynamic pressure homogeneity in the suspension across a width of the channel from the first inlet to the second inlet.

In a further preferred embodiment, the aqueous spacing medium is introduced into the channel generally in a flow direction of the suspension in the channel. As outlined above, this may minimise or reduce any shearing forces which may arise from introducing the aqueous spacing medium into the channel.

As outlined above, the method may be used to increase a rate of a single entity per picodroplet when picodroplets are generated from the suspension.

Therefore, in a related aspect of the invention, there is provided a method for generating droplets from a suspension comprising a plurality of entities, the method comprising: providing a suspension using the method of any of the embodiments described herein; and forming an emulsion of droplets comprising the entities by providing a flow of the suspension to a picodroplet generation region of the microfluidic structure or a microfluidic device which comprises the microfluidic structure described herein. By providing the suspension using embodiments of the method described herein, the probability for obtaining a single entity in a single picodroplet generated from the suspension may thereby advantageously increased.

In a further related aspect of the invention, there is provided a method of promoting a better than Poisson-type number distribution of entities within picodroplets by generating picodroplets using the above-described method for generating picodroplets from a suspension comprising a plurality of entities. A Poisson distribution may thereby be defined by the number of entities in a single picodroplet.

We note that methods, structures and devices as described throughout the specification are equally applicable to picodroplets and microdroplets, i.e. droplets of varying size, and embodiments described herein are not limited to a particular size of the droplet.

In a related aspect of the invention, there is provided a microfluidic structure comprising a main channel with matched opposing side channel manifolds. The advantages outlined above with regard to the microfluidic structure with first and second combs arranged at a (main) channel equally apply to the structure comprising a main channel with matched opposing side channel manifolds.

In a preferred embodiment of the microfluidic structure, the side channel manifolds define a plurality of pairs of side channels on opposite lateral sides of the main channel. This may allow for introducing, for example, a spacing medium into the main channel to space out entities in a suspension, and/or to align entities within the suspension, without applying any (or any significant or destructive) stress to the entities in the suspension as a hydrodynamic pressure homogeneity is ensured throughout the main channel in the regions of the manifolds.

In a further preferred embodiment of the microfluidic structure, the side channels join the main channel at an acute angle. A spacing medium or fluid may thereby be introduced into the main channel via the manifolds without disrupting the general flow of the suspension comprising the entities in the main channel.

BRIEF DESCRIPTION OF THE DRAWINGS

These and other aspects of the invention will now be further described, by way of example only, with reference to the accompanying figures, wherein like numerals refer to like parts throughout, and in which.

DETAILED DESCRIPTION OF PREFERRED EMBODIMENTS

As outlined above, embodiments described herein may be used in microfluidic structures and methods for encapsulation entities, for example cells or other biological entities, and for low stress picodroplet reinjection.

If picodroplets are formed from a suspension, for example an aqueous solution, whereby the suspension comprises cells, the number of cells per picodroplet generally follows a Poisson distribution.

The percentage of empty picodroplets among all picodroplets, the percentage of singlets among picodroplets (i.e. the number of picodroplets containing a single cell versus the total number of picodroplets) and the percentage of singlets among cells (i.e. the number of picodroplets containing a single cell versus the number of all picodroplets containing one or more cells) are dependent on the ratio of the total cell number to the total picodroplet number, which we define as the Poisson lambda value.

The following table shows the percentages of empty picodroplets among all picodroplets (second column), the percentage of singlets among picodroplets (third column) and the percentage of singlets among cells (fourth column) as defined above for Poisson lambda values ranging from 0.1 to 1.5.

TABLE 1

Empty picodroplets among picodroplets, singlets among picodroplets, singlets among cells and cells/mL as a function of the Poisson lambda value:

| Poisson λ | Empty among picodroplets | Singlet among picodroplets | Singlet among cells | Cell/mL |
|---|---|---|---|---|
| 0.1 | 90.5% | 9.0% | 90.5% | 3.33E+05 |
| 0.2 | 81.9% | 16.4% | 81.9% | 6.67E+05 |
| 0.3 | 74.1% | 22.2% | 74.1% | 1.00E+06 |
| 0.4 | 67.0% | 26.8% | 67.0% | 1.33E+06 |
| 0.5 | 60.7 | 30.3% | 60.7% | 1.67E+06 |
| 0.6 | 54.9% | 32.9% | 54.9% | 2.00E+06 |
| 0.7 | 49.7% | 34.8% | 49.7% | 2.33E+06 |
| 0.8 | 44.9% | 35.9% | 44.9% | 2.67E+06 |
| 0.9 | 40.7% | 36.6% | 40.7% | 3.00E+06 |
| 1 | 36.8% | 36.8% | 36.8% | 3.33E+06 |
| 1.1 | 33.3% | 36.6% | 33.3% | 3.67E+06 |
| 1.2 | 30.1% | 36.1% | 30.1% | 4.00E+06 |
| 1.3 | 27.3% | 35.4% | 27.3% | 4.33E+06 |
| 1.4 | 24.7% | 34.5% | 24.7% | 4.67E+06 |
| 1.5 | 22.3% | 33.5% | 22.3% | 5.00E+06 |

As can be seen from table 1, the cell encapsulation quality, i.e. the one-cell-per-picodroplet (OCPD) rate, varies from 90.5% down to 22.3%. This means that more than 77% of cells generally go into picodroplets containing more than one cell.

Figure 1:
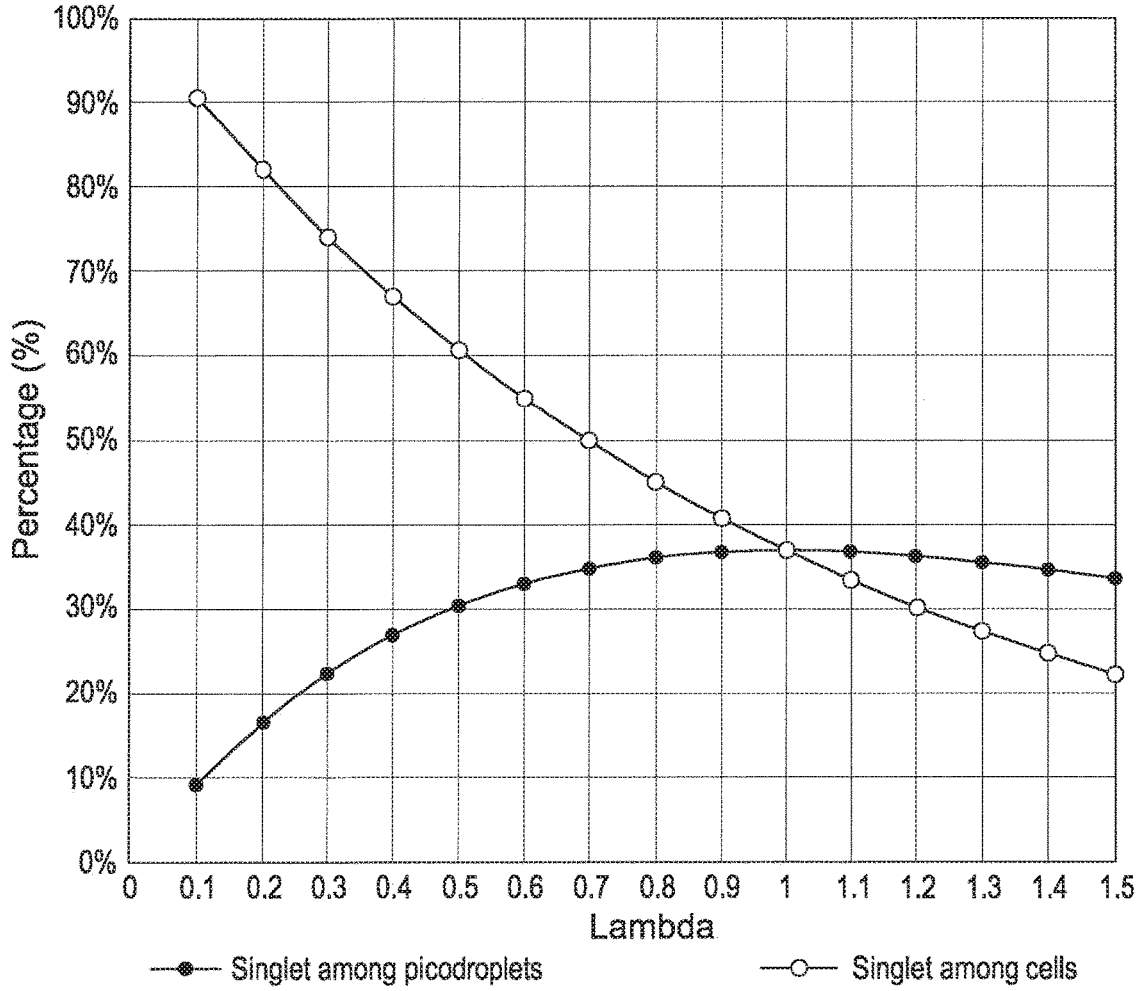
FIG. 1 shows the percentage of a single cell per picodroplet and picodroplets containing any cells, respectively, versus ratio of total cell number to picodroplet number.

The findings of table 1 are shown in FIG. 1.

When a Poisson lambda value of 0.1 is selected, a value of 90.5% of OCPD among cells is obtained, whereas only 9.0% among all picodroplets contain a cell at all. This indicates that ~90% of all efforts may be spent on analysing empty picodroplets.

In some examples described herein, a Poisson lambda value of 0.5 is chosen, as indicated by the row highlighted in blue in table 1. As can be seen, a Poisson lambda value of 0.5 results in 60.7% of the picodroplets being empty and 60.7% of OCPD among all cells.

When the volume of each picodroplet is 300 pL, the cell concentration in the initial bulk suspension is $1.67\times10^6$ cells/mL. Even in the worst situation shown in the above table, i.e. when the Poisson lambda value is 1.5, the cell concentration in the suspension is just $5\times10^6$ cells/mL.

Embodiments described herein allow for approaches to cell encapsulation which may improve upon any Poisson distribution restriction in order to give OCPD quality and efficient cell encapsulation, and maintain a high cell survival rate.

Figure 2:
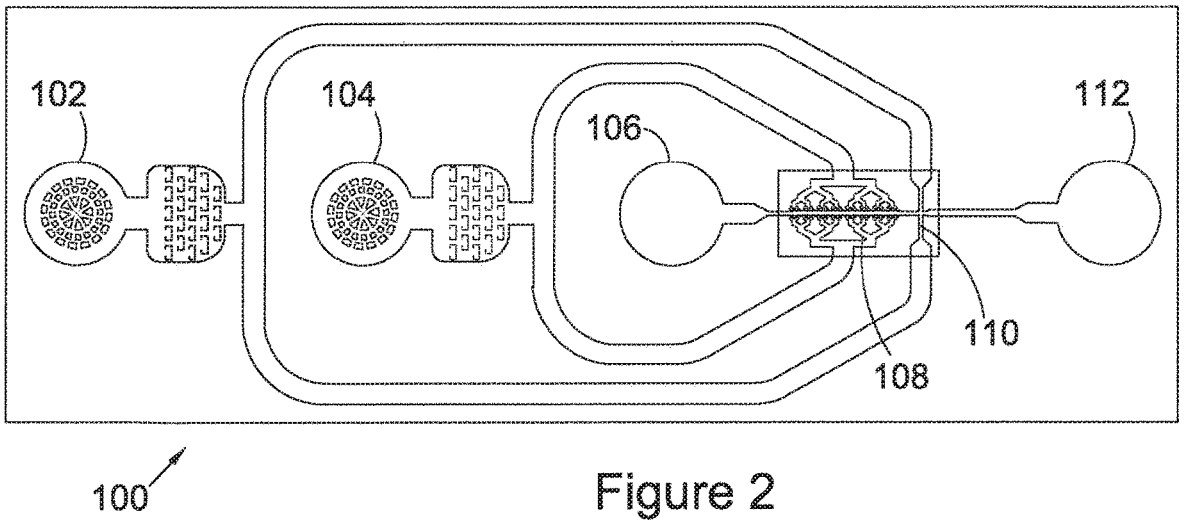
FIG. 2 shows a schematic of a microfluidic device according to embodiments of the present invention.

FIG. 2 shows a schematic of a microfluidic device or structure as generally described herein.

In this example, the microfluidic structure 100 comprises three fluidic inlets in addition to the picodroplet outlet 112.

A fluorinated oil reservoir 102 is provided in this example which is connected to a channel at a cross junction 110 at which discrete picodroplets are pinched off from a continuous aqueous phase at the cross junction nozzle.

The aqueous fluid comprising cells or particles is provided in this example in a reservoir 106 which allows introducing the cells or particles to the cross junction (picodroplet generation region) 110 at which discrete picodroplets are pinched off from the aqueous fluid using the fluorinated oil from reservoir 102.

An additional aqueous spacing medium (for example a culture medium, which may have a different viscosity than water) is provided in this example in reservoir 104. The aqueous spacing medium may be introduced into the main channel in which the cells or particles are guided in the aqueous fluid from the reservoir 106 towards the cross junction 110.

First and second combs 108*a*, 108*b* of inlets are provided on opposing sides of the main channel at a longitudinal position between the reservoir 106 and the cross junction 110 at which the fluorinated oil is used to pinch off discrete droplets from the aqueous fluid comprising cells or particles.

In this example, the additional aqueous spacing medium inlets between the fluorinated oil inlet and the aqueous fluid inlet at reservoir 106 connects with a pair of $2^n$ flow splitting microfluidics which face each other at each side of the aqueous microfluidic main channel for cell or particle suspension.

The combs 108*a*, 108*b* thereby allow for spacing out cells or particles from each other and aligning cells or particles, in this example, in the middle of the aqueous microfluidic main channel before being punch off into discrete picodroplets.

In this example, n=4, resulting in 16 fluidic open mouths or nozzles at each side. However, it will be appreciated that n may be a different number, or alternatively 3 pairs, 5 pairs or any other integer number of pairs of nozzles may be provided via combs 108*a* 108*b*.

In this example, the fluidic flow rates from the nozzles are identical which assures that there is no (or no significant) flow gradient within this spacing region.

Figure 3:
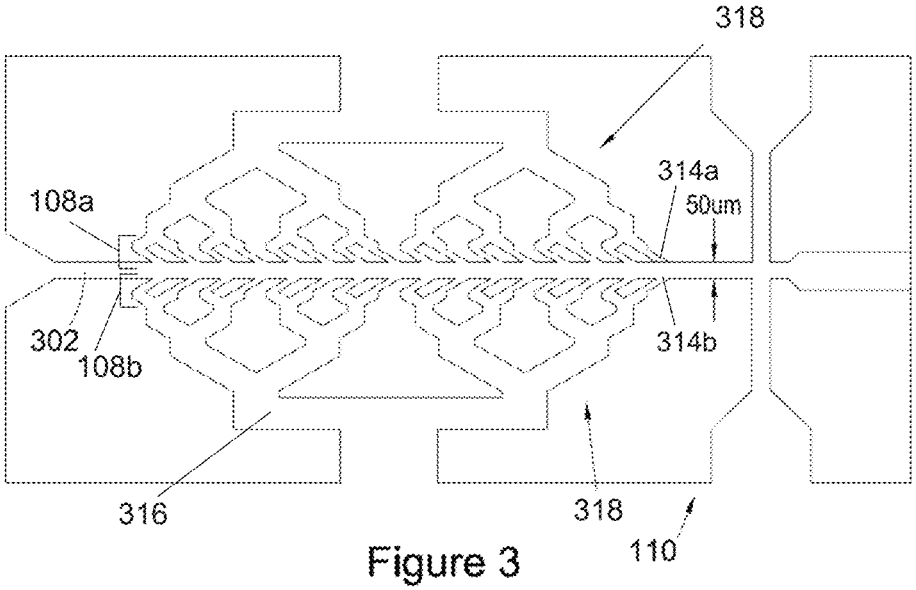
FIG. 3 shows a schematic of a microfluidic structure according to embodiments of the present invention.

FIG. 3 shows a close-up of the schematic of the microfluidic structure of FIG. 2 as indicated in the rectangle in FIG. 2.

As can be seen, in this example, a first comb 108*a* of first inlets and a second comb 108*b* of second inlets are arranged on opposing sides of the main channel 302. A spacing fluid channels provide the spacing medium into the first comb 108*a* of first inlets and the second comb 108*b* of second inlets. The spacing fluid channels include a main spacing fluid channel 316 that joins secondary spacing fluid channels 318. A first inlet 314*a* of the first comb 108*a* of first inlets has a corresponding second inlet 314*b* of the second comb 108*b* of second inlets at a similar longitudinal position along the main channel 302.

In fluid dynamics, laminar flow (or streamline flow) occurs when a fluid flows in parallel layers, with no disruption between the layers. At low velocities, the fluid tends to flow without lateral mixing, and adjacent layers slide past one another like playing cards. There are no cross-currents perpendicular to the direction of flow, nor eddies or swirls of fluids. In laminar flow, the motion of the particles of the fluid is very orderly with all particles moving in straight lines parallel to the pipe walls. Laminar flow is a flow regime characterised by high momentum diffusion and low momentum convection.

In this example, the inlets of the first and second combs 108*a*, 108*b* are at an acute angle to the main channel 302 such that, when the spacing medium is introduced into the main channel 302 via the inlets of combs 108*a*, 108*b*, the aqueous cell or particles suspension is less disturbed when guided through the main channel 302 while the cells or particles are aligned and/or spaced out. This reduces the risk of cell or particle deformation while the cells or particles are aligned within the main channel 302 and/or spaced out.

In this example, the main channel 302 has a width of approximately 50 um.

Two preliminary experiments were carried out in this example using 2.5 um Latex beads.

Experiment 1

This experiment started with a concentration of $2.5\times10^7$ beads/mL. The bead suspension flow rate was set at 50 uL/hr and the spacing fluid water rate was 500 ul/hr, which gave a final bead concentration of $2.27\times10^6$ beads/mL. The fluorinated oil was 5% Pico-Surf-™-1 in Novec-7500 at a flow rate of 1000 uL/hr.

Figure 4:
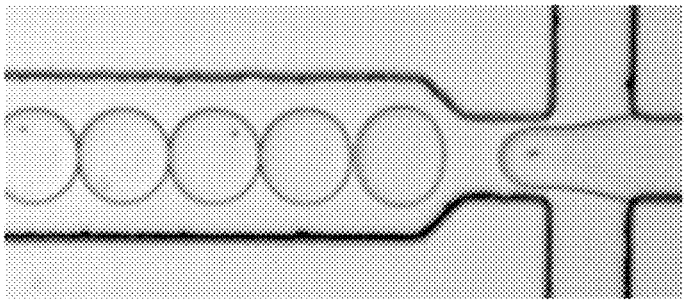
FIG. 4 shows a video snapshot of cells in picodroplets obtained using embodiments of the present invention.

FIG. 4 shows a video snapshot of cells in picodroplets obtained using the above parameters.

In the snapshot (which shows the microfluidic structure only at the cross junction where picodroplets were pinched off from the aqueous cell or particle suspension), 21 OCPD and 1 doublet (a picodroplet containing two cells) were counted. This indicates a higher OCPD rate (95.5%) than that from an encapsulation of a similar final concentration ($2\times10^6$ beads/mL in table 1) of an ideal suspension on a conventional Pico-Gen™ biochip (54.9%).

Experiment 2

In this experiment, a concentration of $2.5\times10^8$ beads/mL, circa 100-fold higher, was used. The bead suspension flow rate was set at 20 uL/hr and the spacing fluid water rate at 500 ul/hr, which gave a final bead concentration $9.6\times10^6$ beads/mL. The fluorinated oil was 5% Pico-Surf™-1 in Novec-7500 at flow rate of 1000 uL/hr.

Figure 5:
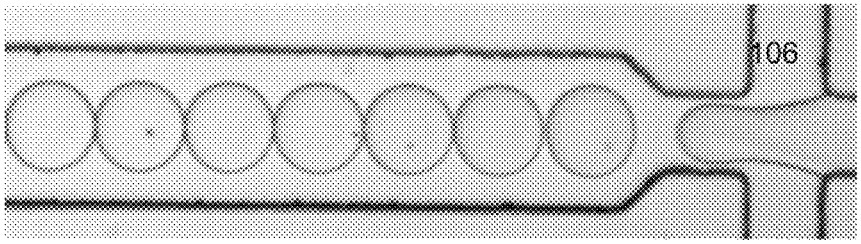
FIG. 5 shows a video snapshot of cells in picodroplets obtained using embodiments of the present invention.

FIG. 5 shows a video snapshot of cells in picodroplets obtained using the above parameters.

In the snapshot (which shows the microfluidic structure only at the cross junction where picodroplets were pinched off from the aqueous cell or particle suspension), 41 OCPD and 3 doublets were counted. This indicates a much higher OCPD rate (93.2%) than that from an encapsulation of a similar final concentration ($5\times10^6$ beads/mL in table 1) of an ideal suspension on a conventional Pico-Gen™ biochip (22.3%).

Further Applications

Such a pair of, in this example, $2^n$ flow splitting microfluidics may be used for picodroplet reinjection on Pico-Sort™ designs.

Figure 6:
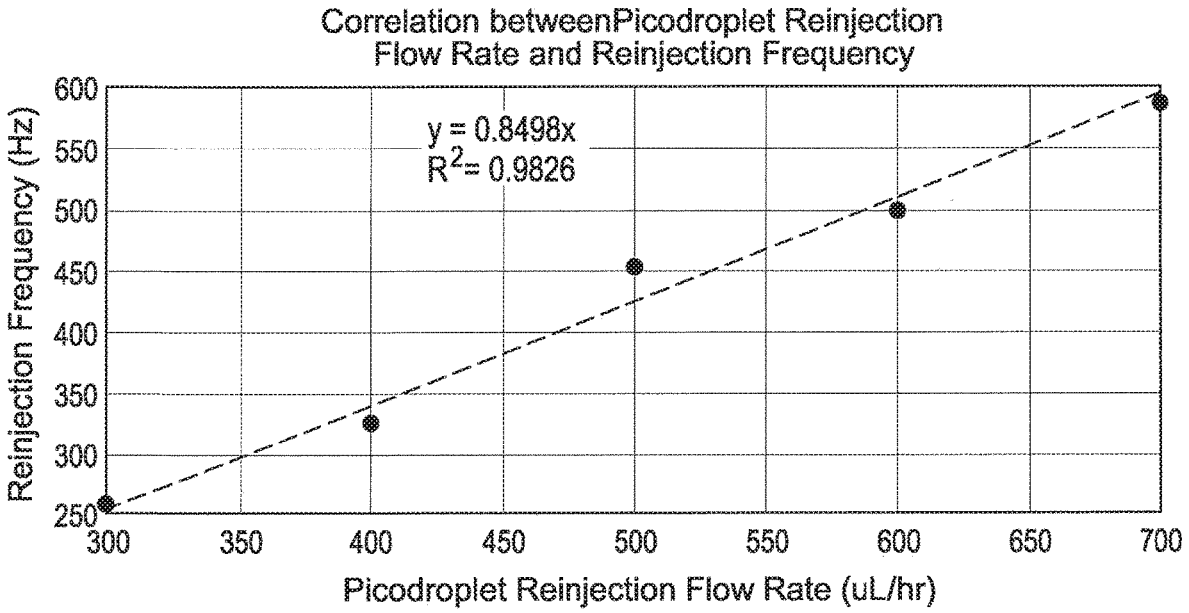
FIG. 6 shows reinjection frequency versus picodroplet reinjection flow rate.

FIG. 6 shows the correlation between the picodroplet reinjection flow rate and the reinjection frequency.

As can be seen in FIG. 6, a linear correlation between the picodroplet reinjection flow rate and the reinjection frequency was observed with a slope of 0.85.

The following table outlined the experimentally observed parameters.

TABLE 2

Correlation between the picodroplet reinjection flow rate and the reinjection frequency:

| Novec7500 (uL/hr) | Picodroplet (uL/hr) | t1 (ms) | t2 (ms) | dt (ms) | No. of Picodroplet | Frequency (Hz) |
|---|---|---|---|---|---|---|
| 3000 | 300 | 4603.6 | 4526.5 | 77.1 | 20 | 259.4 |
| 4000 | 400 | 3982.6 | 3921.6 | 61.0 | 20 | 327.9 |
| 5000 | 500 | 5225.1 | 5181.1 | 44.0 | 20 | 454.5 |
| 6000 | 600 | 1654.6 | 1614.5 | 40.1 | 20 | 498.8 |
| 7000 | 700 | 3362.6 | 3328.6 | 34.0 | 20 | 588.2 |

Such picodroplet reinjection microfluidics was challenged with a very high flow rate of 1,000 uL/hr for picodroplets (300 pL) and 10,000 uL/hr for the re-injection oil (5% Pico-Surf™ 1 in Novec7500).

Figure 7:
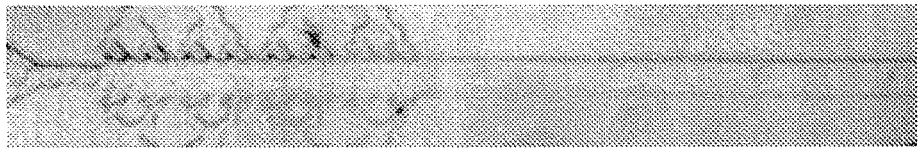
FIG. 7 shows a video snapshot of cells in picodroplets obtained using embodiments of the present invention.

FIG. 7 shows a video snapshot of cells in picodroplets obtained using the above parameters.

From the video (of which FIG. 7 shows a single snapshot), it was observed that the elongation of picodroplets was minor or negligible, as the picodroplets experienced much less stress compared to that experienced in a conventional cross junction. No broken picodroplets were observed at such a high re-injection frequency (~850 Hz).

These observations prove that the cells experience less stress during picodroplet generation, resulting in a higher survival rate of cells contained in the picodroplets.

As outlined above, the flow splitting microfluidic structure may allow for generating a local region (i.e. the area between two corresponding inlets on either side of the main channel) of homogeneous pressure environment. This may assure minimum stress which may be exerted onto fragile cells, entities or picodroplets.

Figure 8:
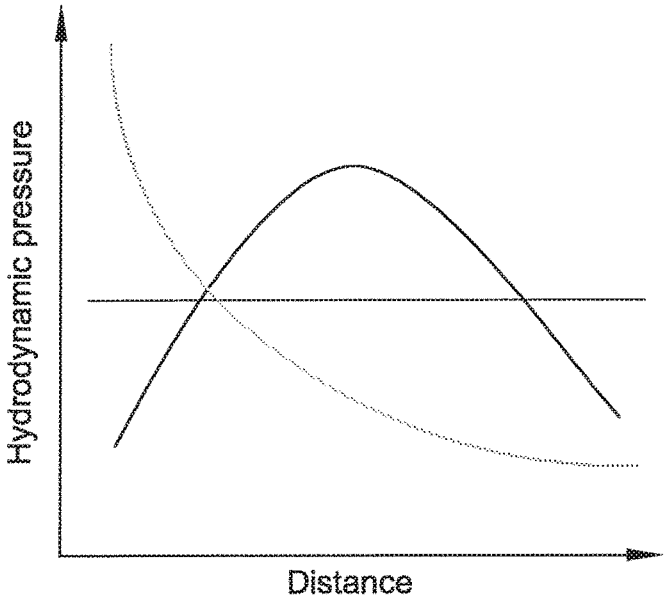
FIG. 8 shows hydrodynamic pressure versus distance.

FIG. 8 shows hydrodynamic pressure versus distance.

The blue line shows a side way comb design which generates a pressure which is higher at the side at which the spacing medium inlet is arranged. The pressure decreases constantly with increasing distance to the spacing medium inlet and the lowest pressure is observed at the opposite side of the channel at which no inlet is arranged.

In a middle way comb design (red line in FIG. 8), a higher pressure is generated in the middle of the channel which is close to the spacing medium inlet, and the pressure decreases to both sides away from the middle way comb. Such a pressure gradient may still result in a stretching force which may be exerted onto the cells or picodroplets, which may cause elongation of cells which may cause a potentially irrevocable destruction of the cells. Equally, the picodroplets may break up into satellite picodroplets.

The brown line in FIG. 8 represent the hydrodynamic pressure across the width of the (main) channel from a first inlet on a first side of the main channel to a corresponding, respective second inlet on the opposite side of the channel. As can be seen, the hydrodynamic pressure is, in this schematic illustration, constant across the width of the channel.

The split fluidic flow, which spreads one big flow stream into multiple small and, in this example, equal flow streams, and homogeneous hydrodynamic pressure within spacing regions ensure the formation of a laminar flow which can align cells in the middle of the microfluidic channel and facilitate single cell encapsulation, in particular as the cells are spaced out within the channel prior to pinching off picodroplets from the suspension to encapsulate a single cell in a single droplet, thereby increasing the OCPD rate beyond that expected from Poisson statistics.

Although aspects and embodiments of the invention described throughout the specification refer to picodroplets (which may be defined as droplets having a volume of less than one nano-litre), the skilled person will appreciate that aspects of the invention and embodiments generally as described herein may equally be used for droplets with other sizes, for example droplets having a volume of 1-1000 nano-litres.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A microfluidic structure for spacing out and aligning entities in an aqueous suspension, the structure comprising:

a main channel for guiding entities in an aqueous suspension;

a first comb of first inlets arranged on a first side of said channel for introducing a spacing medium into said main channel; and a second comb of second inlets arranged on a second side of said channel for introducing said spacing medium into said channel;

a first plurality of spacing fluid channels and a second plurality of spacing fluid channels for providing the spacing medium into the first comb of first inlets and the second comb of second inlets, wherein the first plurality of spacing fluid channels and the second plurality of spacing fluid channels comprise a main spacing fluid channel which joins a plurality of secondary spacing fluid channels, wherein the secondary spacing fluid channels join the first comb of first inlets and the second comb of second inlets, wherein said first side is opposite said second side, and wherein a first inlet of the first comb of first inlets has a corresponding second inlet of the second comb of second inlets at a substantially similar longitudinal position along said main channel;

wherein said first comb of first inlets and said second comb of second inlets comprise a plurality of pairs of inlets joined at an acute angle to the main channel, wherein the secondary spacing fluid channels are smaller than the main spacing fluid channels, and wherein each of said plurality of first inlets and second inlets is smaller than the plurality of spacing fluid channels and the main channel.

2. A microfluidic structure as claimed in claim 1, wherein one or more of said first inlets and one or more of said corresponding second inlets each forms an angle with said main channel of less than 90 degrees.

3. A microfluidic structure as claimed in claim 1, wherein a part of a said first inlet or a said second inlet is coated with a hydrophilic coating.

4. A method of generating picodroplets from a suspension comprising a plurality of entities, the method comprising:

aligning entities in a suspension in a microfluidic structure, wherein aligning entities in a suspension comprises:

providing a channel on said microfluidic structure for guiding said entities in said suspension;

providing a first comb of first inlets arranged on a first side of said channel for introducing a fluid into said channel;

providing a second comb of second inlets arranged on a second side of said channel for introducing a said fluid into said channel;

wherein said first side is opposite said second side, and wherein a first inlet of the first comb of first inlets has a corresponding second inlet of the second comb of second inlets at a substantially similar longitudinal position along said channel;

the method further comprising:

guiding said suspension comprising said entities through said channel;

introducing said fluid into said channel from one or more of said first inlets at the same time as introducing said fluid into said channel from one or more of said corresponding second inlets to align said entities in said suspension in said channel; and forming an emulsion of picodroplets comprising said entities by providing a flow of said suspension to a picodroplet generation region of said microfluidic structure.

5. A method as claimed in claim 4, wherein said fluid is introduced into said channel with a flow rate which is higher than a flow rate of said suspension in said channel to space out said entities in said suspension in said channel.

6. A method as claimed in claim 4, wherein said fluid is introduced into said channel from a said first inlet of the first comb of first inlets with a first flow rate and from said corresponding second inlet of the second comb of second inlets with a second flow rate, wherein said first flow rate and said second flow rate are substantially the same to reduce a hydrodynamic pressure gradient in said suspension across a width of said channel from said first inlet to said corresponding, respective second inlet.

7. A method as claimed in claim 4, wherein said fluid is introduced into said channel in a flow direction of said suspension in said channel.

8. A method of generating picodroplets from a suspension comprising a plurality of entities, the method comprising:

spacing out entities in a suspension, wherein spacing out entities in the suspension comprises:

guiding said suspension comprising said entities through a channel of a microfluidic structure; and introducing an aqueous spacing medium into said channel from a first inlet arranged on a first side of said channel and substantially simultaneously introducing said aqueous spacing medium into said channel from a second inlet arranged on a second side of said channel to space out said entities in said suspension in said channel, wherein said first side is opposite said second side, and wherein said first inlet is arranged at a substantially similar longitudinal position along said channel as said second inlet; and forming an emulsion of picodroplets comprising said entities by providing a flow of said suspension to a picodroplet generation region of said microfluidic structure.

* * * * *